US010542831B2

(12) United States Patent
Katz

(10) Patent No.: US 10,542,831 B2
(45) Date of Patent: Jan. 28, 2020

(54) INTERCONNECTING BLANKET ASSEMBLY DOUBLE LAYERED SLEEPING SYSTEM

(71) Applicant: Rebecca Katz, Baldwin, NY (US)

(72) Inventor: Rebecca Katz, Baldwin, NY (US)

( * ) Notice: Subject to any disclaimer, the term of this patent is extended or adjusted under 35 U.S.C. 154(b) by 0 days.

(21) Appl. No.: 15/289,130

(22) Filed: Oct. 8, 2016

(65) Prior Publication Data

US 2018/0098645 A1 Apr. 12, 2018

(51) Int. Cl.
*A47G 9/02* (2006.01)

(52) U.S. Cl.
CPC ..... *A47G 9/023* (2013.01)

(58) Field of Classification Search
CPC ..... A47C 27/141; A47C 27/05; A47C 27/14; A47C 27/22; A47G 9/00; A47G 9/02
See application file for complete search history.

(56) References Cited

U.S. PATENT DOCUMENTS

| | | | | | |
|---|---|---|---|---|---|
| 4,069,526 | A * | 1/1978 | Deikel | A47G 9/023 | 5/486 |
| 4,771,496 | A | 9/1988 | Cobb | | |
| 4,961,238 | A * | 10/1990 | Limb | A47C 27/085 | 428/156 |
| 4,969,223 | A * | 11/1990 | Yamaguchi | A47C 31/105 | 5/722 |
| 5,109,559 | A * | 5/1992 | West | A47C 27/085 | 5/502 |
| 5,457,830 | A * | 10/1995 | Fox | A47G 9/02 | 5/486 |
| 6,032,308 | A * | 3/2000 | Chuang | A47G 9/0261 | 5/413 AM |
| 6,237,171 | B1 * | 5/2001 | Allen | A47G 9/0207 | 5/482 |
| 7,100,223 | B1 * | 9/2006 | Anthony | A47G 9/0238 | 5/482 |
| 7,200,883 | B2 | 4/2007 | Haggerty | | |
| 8,214,947 | B1 * | 7/2012 | Helton | A47G 9/023 | 5/482 |
| 8,245,334 | B2 * | 8/2012 | Cohen | A47G 9/0261 | 5/482 |
| 8,813,276 | B2 * | 8/2014 | Lee | A61G 7/001 | 5/482 |
| 2005/0144721 | A1 * | 7/2005 | Linnane | A47G 9/0261 | 5/501 |
| 2009/0151072 | A1 * | 6/2009 | Jones, III | A47G 9/02 | 5/486 |
| 2013/0318713 | A1 | 12/2013 | Huang | | |
| 2016/0192786 | A1 * | 7/2016 | Holbrook | A47C 31/105 | 5/691 |

* cited by examiner

*Primary Examiner* — Peter M. Cuomo
*Assistant Examiner* — Ifeolu A Adeboyejo
(74) *Attorney, Agent, or Firm* — Scully, Scott, Murphy & Presser, P.C.

(57) ABSTRACT

An interconnecting blanket assembly for a plurality of users comprising an upper blanket section which further comprises at least two inner blanket sections configured to form a double layered blanket assembly. The inner blanket sections are fixedly attached to the upper blanket section at the centerline of the inner blanket sections via a stitching pattern and a plurality of peripheral edges of the upper blanket section is removably attached to the inner blanket sections via a fastening mechanism to provide selective comfort for the users.

5 Claims, 2 Drawing Sheets

INTERCONNECTING BLANKET ASSEMBLY DOUBLE LAYERED SLEEPING SYSTEM

FIELD OF THE INVENTION

The present invention is relating generally to bed coverings and particularly concerns a permanently connected blanket assembly which defines separate compartments for sleeping areas.

BACKGROUND OF THE INVENTION

Conventional blankets have long been tucked under and around mattresses to confine the feet of the occupants of the bed while keeping them snug and warm. It is desirable to allocate the blanket equally among the occupants. Sometimes, problems can arise when one of these individuals makes an adjustment to suit their preference by shifting the position of a common blanket which creates discomfort and inconvenience and can result in tension. It is tough for the occupants to be comfortable inside the traditional blanket s they are not able to wrap with the peripheral edge nor being able to tuck using the conventional blankets. Numerous attempts for blankets have been made in the prior art, which will be described below in chronological order to show advancement in the art, and which are incorporated herein by reference thereto.

U.S. Patent Application No. 20090151072 assigned to Jones describes a closable dual sleeping system that divides a bed in two for the comfort of two occupants. Here a top comforter and a bottom comforter are removably interconnected down a longitudinal centerline by a mating hook and loop fastener strip to form two separate sleeping compartments.

U.S. Pat. No. 4,771,496 issued to Cobb describes a bed covering includes a flat top sheet interconnected to a fitted bottom sheet along a central longitudinal connecting and reinforcing region. Two separate sleeping compartments are defined which allocate bed space.

U.S. Pat. No. 7,200,883 assigned to Haggerty describes a bedding system comprising a fitted sheet having two sections, each section made of a different fabric and a flat sheet having two sections each section being of a different fabric such that the different materials creating different warming characteristics.

It is apparent that numerous innovations for bed blankets or coverings have been provided in the prior art that are adapted to be used. Furthermore, even though these innovations may be suitable for the specific individual purposes to which they address, however, they would not be suitable for the purposes of the embodiments of the present invention as heretofore described, namely, a double layered and size customizable blanket having both edges of the blanket available to two users.

SUMMARY

According to one aspect of the present invention, an interconnecting blanket assembly for a plurality of users comprising an upper blanket section which further comprises at least two inner blanket sections configured to form a double layered blanket assembly. The inner blanket sections are fixedly attached to the upper blanket section at the centerline of the inner blanket sections via a stitching pattern and a plurality of peripheral edges of the upper blanket section is removably attached to the inner blanket sections via a fastening mechanism to provide selective comfort for the users.

In another preferred embodiment, the materials for the upper blanket section and inner blanket sections are selected from the group of cotton, polyester, rayon and mixtures thereof. The standard sized sheets King, California King, Queen, Full, X-Long Twin, and Twin are formed by utilizing at least two inner blanket sections and the upper blanket section so as to allow the blankets to be customizable in size. The upper blanket section and inner blanket sections are fastened on their peripheral edges via sewing with or without using snaps or fastener.

DETAILED DESCRIPTION OF THE INVENTION

Figure 1:
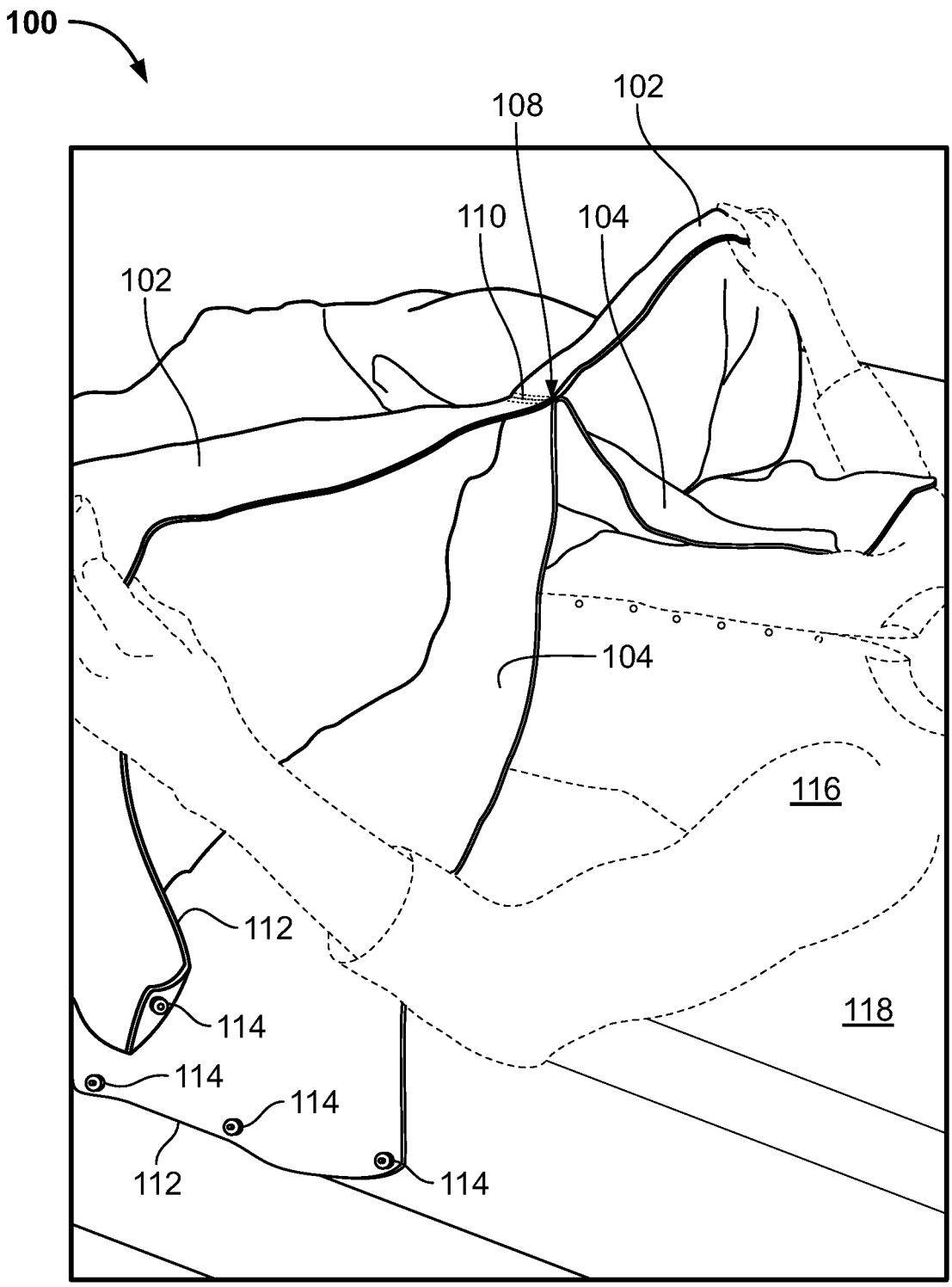
FIG. 1 is a perspective view of an interconnecting blanket assembly showing an upper blanket section and a single lower blanket section for a single user, according to an embodiment of the invention.

Prior to proceeding with the more detailed description of the present invention it should be noted that, for the sake of clarity, identical components which have identical functions have been designated by identical reference numerals throughout the several views illustrated in the drawings.

According to FIG. 1 which shows an interconnecting blanket assembly 100 for a single user 116. The interconnecting blanket assembly 100 comprises an upper blanket section 102 made from a material such as cotton, rayon, polyester, lyocell and blends thereof. The upper blanket section 102 acts like a traditional blanket such as covering the whole bed 118 and allow users 116 to tuck in their legs on both sides. The interconnecting blanket assembly 100 comprises at least two inner blanket sections 104 configured to form a double layered blanket assembly. The inner blanket sections 104 can be made from the same material as the upper blanket section 102. The material can be selected from cotton, rayon, polyester, lyocell and blends thereof. In some embodiments, the upper blanket section 102 and the inner blanket section 104 can be made from different materials. To form the double layered blanket assembly, the inner blanket sections 104 are fixedly attached to the upper blanket section 102 at the midpoint or centerline 108 of the inner blanket sections 104 via a stitching pattern 110. A plurality of peripheral edges 112 of the upper blanket section 102 is removably attached to the inner blanket sections 104 via a fastening mechanism 114 to provide selective comfort for the users 116. In this embodiment, FIG. 1 a single inner blanket section 104 is sewn using the stitching pattern 110 is shown in midpoint or centerline 108 for representation purpose.

Figure 2:
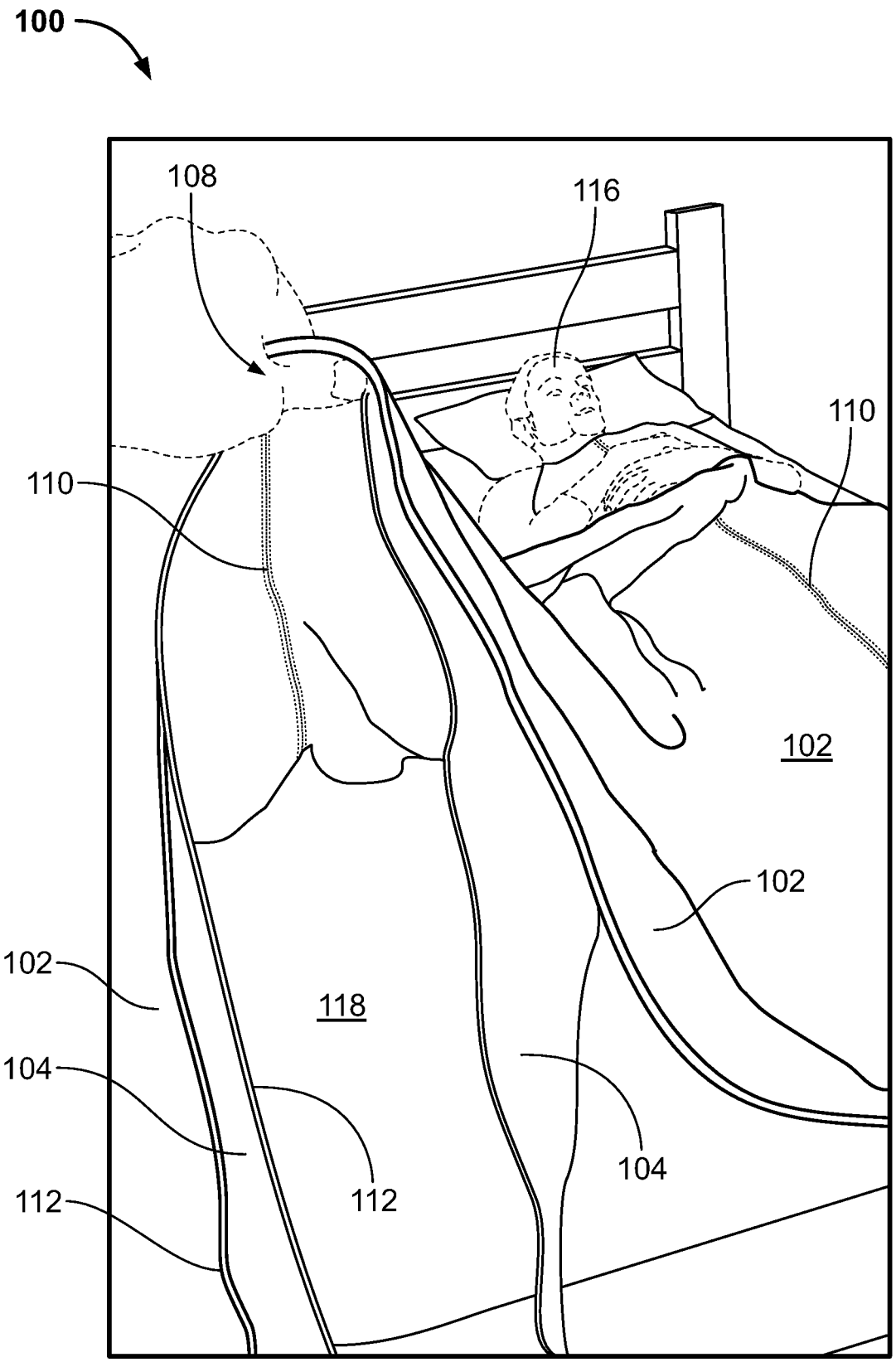
FIG. 2 is a top perspective view of the interconnecting blanket showing the upper blanket section and two lower blanket sections for two users, according to an embodiment of the invention.

According to FIG. 2 shows the interconnecting blanket assembly 100 showing the upper blanket section 102 and two lower blanket sections 106 for two users 116, according to an embodiment of the invention. In this embodiment of the invention, inner blanket section 104 comprises two compartments sewn to the upper blanket section 106 via the midpoint or centerline 108 in each of the compartments. Thus, the interconnecting blanket assembly 100 of the present invention allows two users 116 to share the same bed 118 and also can enjoy their preference of being covered or uncovered without impacting the preference of the other. The interconnecting blanket assembly 100 also covers a variety of bed covers such as blankets, comforters or spreads which are also split similar to the sheets. The interconnecting blanket assembly 100 does not have any leg constraints so that the user can have access to both left and right edges of the blanket for use and can tuck their legs according to own preferences. The interconnecting blanket assembly 100 comprises two vertical open edges available for each person such that the interconnecting blanket assembly 100 can be easily be pulled up or down selectively according to the preference of the user 116. Also, the interconnecting blanket assembly 100 will be unobtrusive and aesthetically pleasing when not in use.

According to the preferred embodiment, the inner blanket sections 104 are sewn to the upper blanket section 102 at midpoint or centerline 108 of the inner blanket sections 104. There exists a sufficient overlap to make the interconnecting blanket assembly 100 appear as one piece on the bed 118. The inner blanket sections 104 are individual sections configured to provide selective comfort for at least two users 116. The upper blanket section 102, the inner blanket sections 104 and the eight corners of the blanket are fastened on their peripheral edges 112 via the fastening mechanism 114 disposed at predetermined intervals. The fastening mechanism 114 is selected from at least one of a snap, a buttons, a slide, a hook and loop fastener, a VELCRO® strap, a latch, a clasp and a clip. In a preferred embodiment, the upper blanket section 102 and inner blanket sections 104 are also fastened on their peripheral edges 112 via sewing at predetermined intervals. In a preferred embodiment, the interconnecting blanket assembly 100 can be converted and joined at all eight corners i.e all four outer corners and four inner corners can be joined together to convert the dual layered blanket into one regular standard blanket. In another preferred embodiment, the interconnecting blanket assembly 100 in a non-conversion model, all the eight corners of the blanket does not include any joining capabilities to convert the dual layered blanket into a one ply standard blanket. The blanket assembly is configured to fit the plurality of beds 118 having different sizes such as King, California King, Queen, Full, X-Long Twin, and Twin.

In a preferred embodiment, the upper blanket section 102 and inner blanket sections 104 are selected with varying decorations. The fabric of interconnecting blanket assembly 100 may also optionally be made soft and fluffy. Besides cotton, polyester, rayon the material may be high loft, needle punched, air laid or otherwise non-woven cotton or other material.

In the present invention, the fixed attachment of the upper blanket section 102 and the inner blanket sections 104 provides more convenience to the users 116. The interconnecting blanket assembly 100 has two individual inner blanket sections which are not separated by any physical barriers and also it is a non divided blanket. The interconnecting blanket assembly 100 allows the user 116 to climb in bed 118 without being confined and enhances the sharing of territory and comfort; resolves the problems of shared space for the users 116. The interconnecting blanket assembly 100 gives a warmth feel to the user 116 and also it has no external attachments. The interconnecting blanket assembly 100, according to the present invention, is user-friendly and cost-effective.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

The invention claimed is:

1. An interconnecting blanket assembly for a plurality of users, the blanket assembly comprising:

an upper blanket section;

a first inner blanket, wherein the upper blanket section is attached to the first inner blanket section at a seam, wherein the seam of first inner blanket section separates the first inner blanket section at a centerline, wherein an upper blanket perimeter of the upper blanket section overlaps an inner blanket perimeter of the first inner blanket section and a second inner blanket section, wherein the upper blanket section is attached to the second inner blanket section at a seam, wherein the seam of second inner blanket section separates the second inner blanket section at a centerline, wherein an upper blanket perimeter of the upper blanket section overlaps an inner blanket perimeter of the second inner blanket section, wherein the first inner blanket section and the second inner blanket section do not overlap each other and wherein the upper blanket is dimensioned to overlap both the first inner blanket section and the second inner blanket section, and wherein the interconnecting blanket assembly is configured to be selectively positioned on top of a user while the user is on a mattress, wherein the interconnecting blanket assembly is dimensioned for placement over a bed cover.

2. The blanket assembly according to claim 1, wherein the material for the blanket assembly is selected from the group consisting of cotton, rayon, polyester, lyocell and blends thereof.

3. The blanket assembly according to claim 1, wherein the blanket assembly further comprises a plurality of fasteners, wherein the plurality of fasteners are only positioned near both the perimeter of the upper blanket section the inner blanket perimeter and the perimeter of the two inner blanket sections, respectively, and wherein both a vertical upper edge and a vertical lower edge of both the upper blanket section and the inner blanket perimeter are open and do not include fasteners, and wherein the plurality of fasteners are disposed at predetermined intervals.

4. The blanket assembly according to claim 3, wherein the plurality of fasteners are selected from a group consisting of at least one of a snap, buttons, a slide, a hook and loop fastener, a latch, a clasp and a clip.

5. The blanket assembly according to claim 1, wherein the blanket assembly is configured to fit a plurality of beds having different sizes, wherein the interconnecting blanket assembly only covers a top of the mattress.

* * * * *